United States Patent [19]

Kantor

[11] 4,036,541

[45] July 19, 1977

[54] LOCKING ARRANGEMENT FOR CABINETS

[76] Inventor: Seymour M. Kantor, 9 Errol Place, New Rochelle, N.Y. 10809

[21] Appl. No.: 699,818

[22] Filed: June 24, 1976

[51] Int. Cl.[2] ..... E05B 65/46; E05D 13/04

[52] U.S. Cl. ..... 312/138 R; 312/217; 292/DIG. 46; 49/449

[58] Field of Search ..... 312/216, 217, 218, 138 R; 70/129; 49/449, 413; 292/83, 87, DIG. 46

[56] References Cited

U.S. PATENT DOCUMENTS

| | | | |
|---|---|---|---|
| 961,197 | 6/1910 | Anderson | 49/449 |
| 2,729,498 | 1/1956 | Law | 312/216 |
| 2,883,250 | 4/1959 | Tod et al. | 312/138 R |
| 3,085,300 | 4/1963 | Carlston | 292/DIG. 46 |
| 3,151,901 | 10/1964 | Ahlgren | 292/DIG. 46 |
| 3,389,943 | 6/1968 | Jones et al. | 312/138 R |

*Primary Examiner*—Paul R. Gilliam
*Assistant Examiner*—Victor N. Sakran
*Attorney, Agent, or Firm*—Arthur A. March

[57] ABSTRACT

A cabinet having an access opening and sliding panels each occupying more than slightly one half of said opening with notches aligned with each other at the base of each opening, a base for said cabinet comprising upper and lower base plates with a space therebetween, a relatively elongate rod having a finger section at its front end and secured near its rear end to the underside of the said upper base plate, the finger section extending into an aperture in the central front portion of said base plate disposed below the aligned notches in the panel, said finger section of the rod being accommodated in the notches when the panels are in closed position, a cross member secured at right angles to the rod intermediate the rod rearwardly of the finger section, a trim piece covering the space between the upper and lower base plates having a slot therethrough and a channel member forming a guideway with the slot extending toward the rear of the cabinet and secured to the front upper portion of the lower base plate, plus a shaped tool of predetermined dimension for extending into the slot in the trim piece and the guideway to the rear thereof for engaging the cross member to move it downwardly whereby the finger section on the rod is also moved downwardly out of contact with the blocking relation to the panels which are then free to move to open the cabinet, said finger section returning into blocking position automatically when the panels are closed and the notches realign above the aperture accommodating the finger section of the rod.

26 Claims, 6 Drawing Figures

FIG. 1
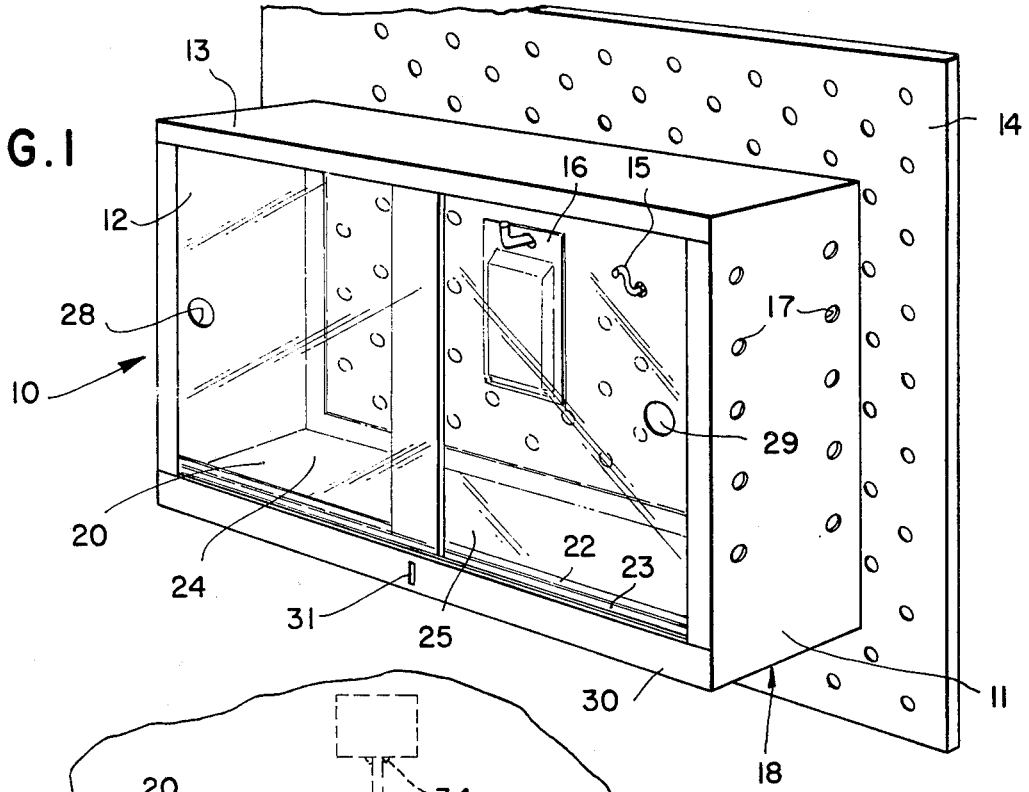
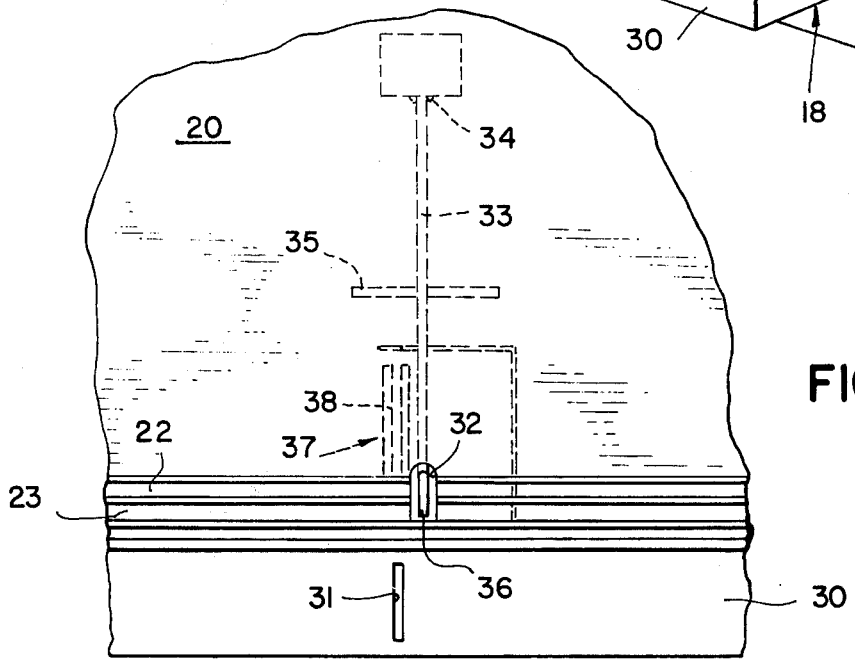
FIG. 2
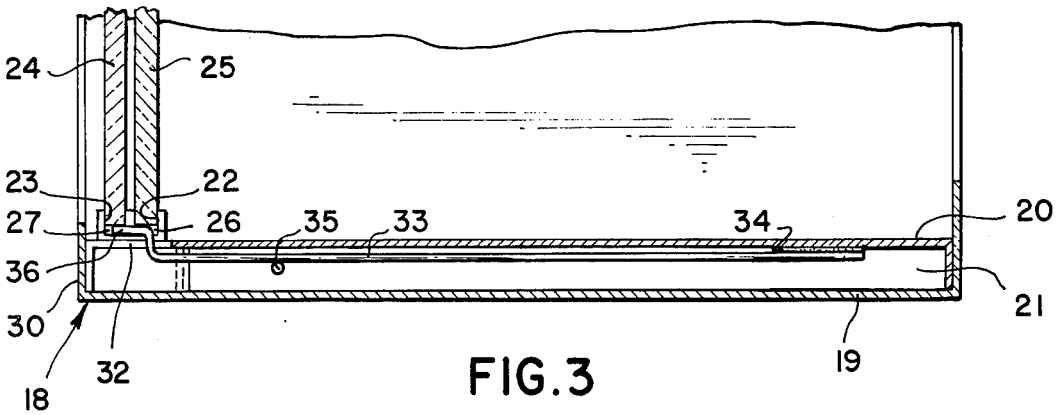
FIG. 3

LOCKING ARRANGEMENT FOR CABINETS

BACKGROUND OF THE INVENTION

For many years an ever increasing problem has existed involving the theft of merchandise from areas used for the display and sale thereof. This problem is not resolvable merely by placing the merchandise in concealed areas as it is essential that they be exposed and easily accessible when the sale is accomplished.

There have been numerous attempts to solve the foregoing problem, as for example, by the provision of standard lock arrangements having conventional keys which are engaged with the cabinet doors and the provision of locks with internal bar arrangements adapted to engage portions of the cabinet panels and prevent unauthorized opening thereof. Still other attempts proposed devices which include ratchet and cam arrangements in order to overcome the pilferage problem which was not solved thereby but instead increased in enormity. The unacceptability of the structure of the proposed solution is in part due to the complexity of the proposed structures, in part due to the relative expense thereof and in part due to the inability of the apparatus to satisfactorily function. In addition, the mechanisms of the proposed solutions were susceptible to the breakdown of any one of a number of cooperating parts which made the devices difficult to lock and subsequently unlock.

Of significance is the fact that prior art devices required that the lock, once opened, be physically closed by a separate independent operation once the merchandise had been removed. In many instances, this independent locking action was overlooked by the party dispensing the merchandise whereupon the goods remained exposed to pilferage. As a consequences, in many instances the devices which were the subject of the proposed solutions to the problem were discarded.

SUMMARY OF THE INVENTION

The present invention provides locking means which overcome the foregoing problems by a unique mechanism which completely safeguards against pilferage. The locking structure is such that it can be released with facility using a very simple tool whereupon the merchandise is readily available for dispensing and sale.

The locking structure of the present invention is particularly adapted for use in display cabinets or modules which are provided with transparent or partially transparent sliding panels across the front portion of the module. The module may be selfsustaining or it can be affixed to a pegboard or the like in an easily removable fashion.

A feature of the present invention is the provision of structure wherein the panels which have been opened to expose the merchandise may be closed and automatically locked in position without requiring any separate or independent locking action on the part of the user.

Another feature of the invention is that the module or cabinet embodying the unique locking structure is otherwise relatively conventional. The module may comprise of a top, bottom and side walls with either a complete rear wall or it may be secured to an existing pegboard or the like. The front portion of the module comprises sliding panels which are horizontally slidable relative to each other on a track to expose and make available the contents of the module or to close the same against pilferage.

The bottom portion of the module comprises a lower base plate and an upper base plate which are spaced from each other to provide an area which accommodates and conceals the locking structure. The locking structure preferably comprises an elongate rod provided with an obstruction or blocking means in the form of a finger segment. The rear section of the rod is secured to the underside of the upper base plate and extends forwardly thereunder. The front portion of the upper base plate and the bottom of the top wall are provided with tracks which accommodate slidable panels. Each of the panels preferably occupy more than approximately one-half of the area at the front of the module or cabinet so that the panels overlap. The panels are horizontally slidable in the aforesaid tracks to open and close the cabinet. A slot extends either at a right angle or diagonally across the central portion of the tracks and the slot is so dimensioned as to accommodate the finger segment of the rod in such a fashion that this segment normally protrudes through the slot into the path of the tracks in the upper base plate.

Intermediate the front and rear of the elongate rod is a cross member which is welded or otherwise firmly secured to the locking rod. This cross member extends on a diagonal to the rod and as illustrated, may be substantially right angles thereto but it is within the purview of this invention to provide other means for the purpose hereinafter described.

A trim piece is disposed around the base of the module to enclose the space between the lower base plate and the upper base plate. A vertical slot extends through said trim piece. A channel member is secured to the top of the lower base plate and extends into the area between the upper and lower base plates. The channel member is located directly to the rear of the slot in the trim piece and the channel is upwardly inclined from front to rear.

The lower edges of each of the sliding panels are provided with aligned notches which are disposed so that they are located directly over the slot in the tracks on the upper base plate when the panels are in closed position. In this position, the occlusion means or finger segment of the rod of the locking structure extends through the slot in the tracks into the aforesaid notches in the lower edge of the sliding panels and blocks each panel against horizontal movement. This position is maintained under the spring-like action of the locking rod which is the result of the attachment of only the rear portion of the rod to the underside of the upper base plate.

A pre-formed tool is provided to accomplish the opening of the module by moving the finger segment of the locking rod out of its protrusion through the slot in the track area into the notches in the panels. The tool is so constructed as to be slidable into the vertical slot disposed in the front central portion of the trim piece around the base of the module and will automatically ride up the inclined plane in the channel member which is directly behind the said slot. The continuance of this movement causes the shaped forward end of the tool to engage the cross member extending diagonally to the locking rod. The tool is provided, for example, with a bevelled forward end so that upon its further insertion, it will cause the aforesaid cross member to be depressed. This downward movement of the cross member causes the rod to which it is secured to also move downwardly whereupon the finger or blocking segment of the rod is depressed and removed from the tracks and out of engagement within the notches in the lower edges of the panels. The panels are thereby released so that each of them may be moved horizontally along the tracks to open the display module and make available the contents thereof. The releasing means or tool, the inclined channel, the cross member and the rod may be made of a variety of pre-determined dimensions so that, if desired, they will interfit in only one module locking arrangement to thereby prevent any interchangeable use of this tool to open different modules.

To close the panels it is merely necessary to horizontally slide them across the face of the module. In so doing, the lower edges of the panels slide over the top of the finger segment of the locking rod maintaining it in a depressed position until the notches on the underside of each panel are disposed above the slot in the tracks and the finger segment of the rod. When this position is attained, the rod will be released to spring upwardly and into engagement within the notches. Thus there is no additional locking action required in order to lock the module because the horizontal movement of the panels itself enables the engagement of the finger segment with the notches in the panels to lock them in position.

While the foregoing summary of the invention and the detailed description hereinafter set forth are provided to facilitate an understanding thereof, it is to be understood that the illustrative forms and descriptions are in no way intended to be a limitation upon the scope of this invention.

BRIEF DESCRIPTION OF THE DRAWINGS

In the drawings:

FIG. 1 is a side perspective view of the module or cabinet embodying the present invention;

FIG. 2 is a full perspective view of the central portion of the module showing the locking structure;

FIG. 3 is sectional view of the combined parts of the locking structure;

DETAILED DESCRIPTION OF THE INVENTION

Figure 4:
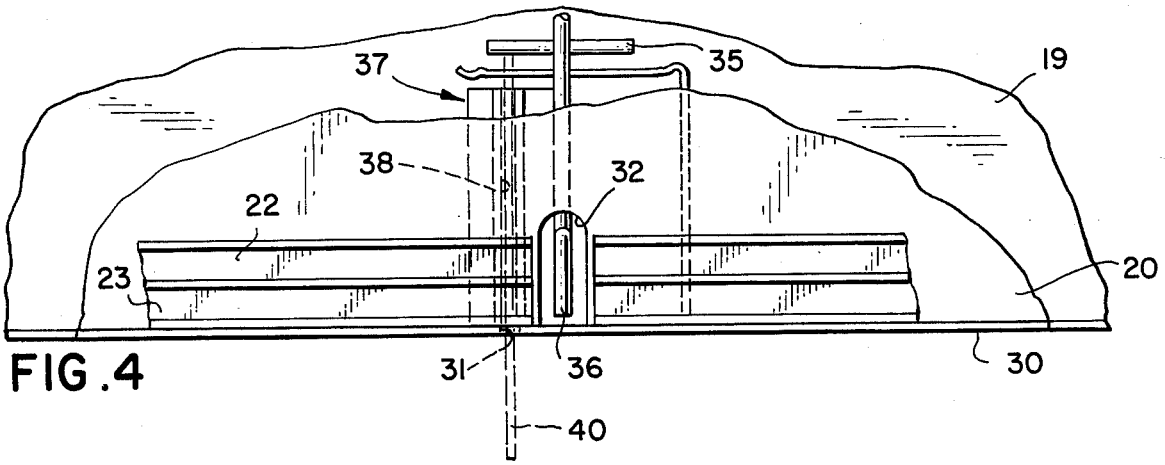
FIG. 4 is a top view of the channel member of the locking structure.
Figure 5:
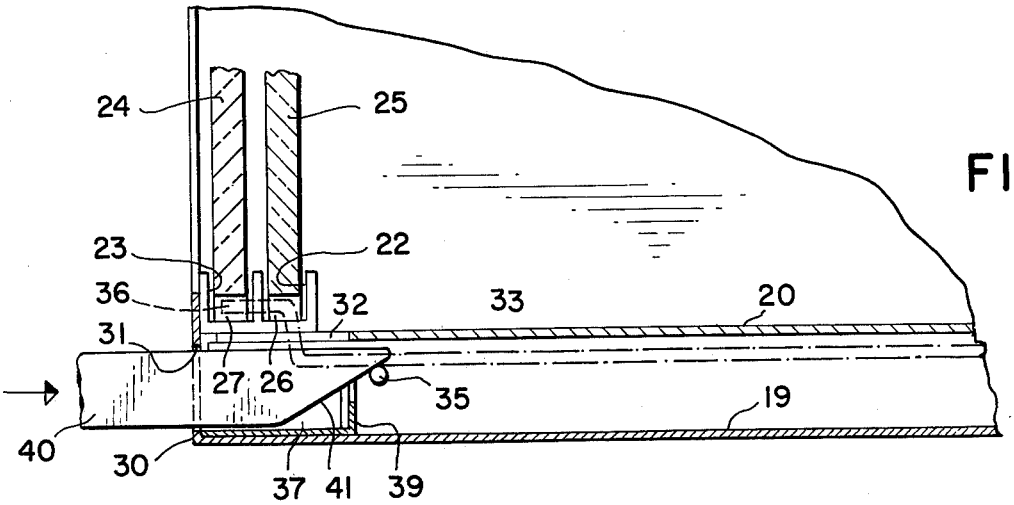
FIG. 5 is a side sectional view of the locking structure with the appropriate tool in position to open the lock.

As shown in the embodiment of the invention illustrated by the drawings, the module which encompasses the locking structure comprises a cabinet 10 having side walls 11 and 12 and a top wall 13. The cabinet 10 may be supported by a peg board 14 which constitutes the rear wall of the cabinet with the removable pegs 15 in the peg board carrying items of merchandise 16 within the cabinet. Should a completely enclosed cabinet be desired, a separate rear wall (not shown) could be utilized in place of the peg board 14. The side walls 11 and 12 may also be provided with apertures 17 for securing cabinets to each other or for the maintenance of the cabinets by other means in any desired location.

The bottom 18 of the module 10 comprises a lower base plate 19 and an upper base plate 20 which are spaced apart from each other leaving an open area 21 therebetween.

As shown, the front portion of the upper base plate is provided with tracks 22 and 23 extending across the surface of the upper base plate 20. The tracks 22 and 23 may comprise independent plates provided with grooves or they may be formed as a part of the top wall 13 and the upper base plate 20 on any suitable forming machine. Front panels 24 and 25 are disposed over the front area of the module or cabinet and are horizontally slidable along the tracks 22 and 23 respectively. Each of the panels occupies slightly more than one-half of the overall space of the front area of the module with the inner edges of each panel being in overlapping relation. The panels, when in closed position, completely enclose the front of the module and there can be no access to the merchandise when these panels are locked as heretofore described. As shown, the panels may be transparent although any type of material may be used therefor. Notches 26 and 27 are located in the lower edges of each of the panels 24 and 25 respectively. These notches are located in horizontal alignment with each other when the panels are in closed relation with their central vertical edges overlapping each other. Finger grips 28 and 29 are provided in each panel to facilitate the manual manipulation and movement thereof.

The open area 21 between the lower base plate 19 and the upper base plate 20 is concealed by a trim piece 30 extending around the perimeter of the base of the module. A vertical slot 31 is provided in the central portion of the trim piece preferably adjacent to the notches 26 and 27 in the lower edges of the panels and forms a part of a guideway for the purposes hereinafter set forth. The slot 31 is appropriately pre-dimensioned for the purposes hereinafter set forth according to the desire of the manufacturer and/or the user of the module.

An aperture or horizontal slot 32 is provided in the forward central portion of the upper base plate preferably immediately adjacent to the aforesaid vertical slot 31 and below the notches 28 and 29 in the lower edge of the front panels. This horizontal slot 32 extends through the central portion of the tracks or track areas 22 and 23.

A locking rod 33 is disposed transverse of the underside of the upper base plate 20. As shown, there is one spot joinder of the rod 33 to the underside of the base plate as, for example, by a weld 34. The rear portion of the rod 33 is therefore secured to the underside of the rear portion of the upper base plate 20 providing it with a spring-like action for returning to normal position in the event it is moved and then released.

Intermediate the ends of the rod 33 is a control means shown in the form of a cross member 35. The cross member 35 may also be secured to the rod by welding or any other suitable fashion or manner and extends diagonally or at right angles to the rod. The forward end of the rod is provided with an obstruction element illustrated in the form of a finger segment 36 which is so constructed as to protrude through the slot 32 in the tracks 22 and 23 when the rod is in its normal unbiased position as illustrated in FIG. 3. The protrusion of the finger 36 through slot 32 causes it to become accommodated in the notches 26 and 27 in the sliding panels 24 and 25 respectively when the panels are in the closed position illustrated in FIG. 1. In this position with the finger 36 in engagement with the notches 26 and 27 as described, the panels 24 and 25 cannot be moved in any direction and are thereby locked securely preventing the merchandise contained in the module from being pilfered or stolen.

A guide element 37 provided with a guideway 38 is secured to the front upper surface of the lower base plate 19. The guideway extends horizontally directly to the rear of the vertical slot 31 which thereby forms a part thereof, and is preferably provided with a rearwardly inclined plane or other upwardly thrusting means 39 for the purpose hereinafter set forth.

Figure 6:
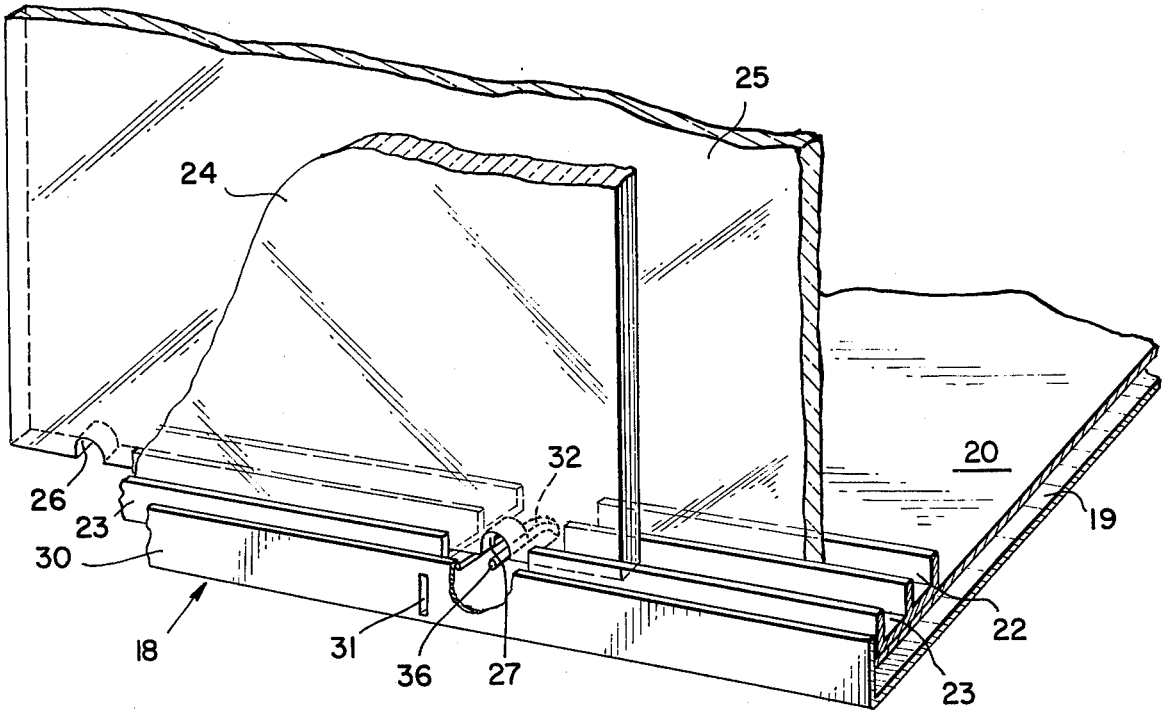
FIG. 6 is a perspective view of the locking structure of the present invention with the panels of the module in an open position after the tool has enabled the opening thereof.

A pre-shaped tool 40 illustrated in the form of a relatively thin elongate member is the means for opening the module by releasing the front panels 24 and 25 enabling them to be horizontally moved in the tracks 22 and 23. The tool, as illustrated, is provided with a bevelled forward edge 41 although as hereinafter set forth many constructions may be used for opening the module depending upon the specific construction of the locking bar and of the remainder of the locking structure. The tool 40 is inserted in the vertical slot 31 and is then accommodated in the guideway 38. Further inward movement causes the tool to move upwardly on the inclined plane to a point where its top engages the cross member 35 in the position shown in FIG. 3. In order to open the module by releasing the lock it is only necessary to further insert the tool 40 whereupon it will cause the cross member to be moved downwardly. This downward movement carries the rod 33 with it causing the rod to move in the same direction whereby the finger segment 36 is moved out of the notches 26 and 27 in the panels 24 and 25 and below the tracks 22 and 23 to the open position shown in FIG. 6. The panels 24 and 25 are then free to be moved in the tracks to expose the merchandise and make it accessible.

An important accomplishment of the present invention is the fact that when the panels are opened the tool may be removed from the slot 31 while, nonetheless, the occlusion member or finger 36 is maintained in a depressed position by the lower edge of the panels 24 or 25. However, to close the cabinet it is only necessary to slide the panels horizontally with relation to each other whereupon the notches 26 and 27 will be brought into position over the horizontal slot 32. The finger 36 carried by the rod 33 will then be released and the aforesaid spring-like action will cause the finger to thrust upwardly through the slot 32 and become again engaged in the notches 26 and 27. Thus the present invention provides means for automatically locking the module without requiring any turning of keys, movement of bars, or any external independent means.

The module of the present invention may comprise any one of a number of materials such as metal, plastic, or wood and there is no limitation of the invention imposed by the material utilized. Furthermore while the invention has been described in detail with reference to one embodiment to facilitate an understanding thereof the concept may, of course, be used for many other purposes. For example, the structure may be utilized in connection with a medicine cabinet wherein dangerous medicines may be prevented from inadvertent accessability to children or other unknowing persons.

It is further to be understood that while the release means shown in the form of a tool and the guideways have been illustrated as relatively thin and narrow units such structure is merely for illustrative purposes and thus the tool and the guideways may be made of a variety of sizes and shapes in which the parts only need to be dimensioned so as to accommodate each other. Furthermore while parts such as horizontally extending tracks have been illustrated the invention may be accomplished without such tracks across the front of the upper base plate as for example by suspending sliding panels or by utilizing moveable means such as wheels on the panels in place of the tracks.

The foregoing description of modifications as well as the illustration in the drawings and the description are not in any way intended to limit the scope of the invention and variations and modifications may be made without the parting from the spirit as defined in the appended claims.

What is claimed is:

1. Locking means comprising:

a plate member, a trim piece angularly extending from said plate member and having an insert aperture, an obstruction element disposed below the plate member and mounted for movement into and out of a blocking position and normally resiliently biased toward such blocking position, means defining a selectively shaped restrictive tool insert guideway extending along a path from the front toward the rear of said plate member, and control means operatively connected to the obstruction element for effecting the movement of the obstruction element out of the normally biased blocking position upon exterior insertion through said insert aperture of a corresponding selectively shaped cooperating tool into the guideway and along such path and into coactive motion transmission contact with such control means.

2. Locking means according to claim 1 wherein the plate member is provided with an obstruction element accommodating slot in operative alignment with the obstruction element to permit projection of the obstruction element upwardly therethrough to blocking position.

3. Locking means according to claim 2 wherein the plate member is an upper plate member and the trim piece extends downwardly therefrom to a lower plate member thereby together to define a base having an enclosed space therebetween, and the obstruction element is concealed within the enclosed space and resiliently mounted at the underside of the upper plate member and normally upwardly biased to project through the accommodating slot to blocking position.

4. Locking means according to claim 3 wherein the obstruction element includes an elongate locking rod resiliently mounted at one end thereof to the underside of the upper plate member remote from the insert aperture and having a finger segment at the other end thereof in the vicinity of the accommodating slot for projection therethrough to blocking position.

5. Locking means according to claim 4 wherein the control means includes a cross member mounted on the elongate rod and situated crosswise of the path of the guideway for coactive motion transmission contact with the cooperating tool.

6. Locking means according to claim 5 wherein the guideway is arranged to provide an inwardly and rearwardly directed path for the cooperating tool in operative alignment with the cross member.

7. Locking means according to claim 6 wherein the base is adapted to form a corresponding wall portion of a pilferage protection cabinet housing having an access aperture, and the upper side of the upper plate member is provided with means defining a portion of a predetermined path for sliding panel means movable along such path for closing and opening the access aperture so as to permit operative alignment thereof with the accommodating slot when moved to a position closing such access aperture and in turn operative locking thereof by the obstruction element upon upward projection through the accommodating slot to blocking position.

8. A pilferage protection cabinet comprising:

a housing having an access aperture, sliding panel means movable along a predetermined path for closing and opening the access aperture, an obstruction element disposed within the housing and mounted for movement into and out of blocking position and normally resiliently biased toward such blocking position for blocking contact with the sliding panel means to prevent the opening thereof when such sliding panel means is moved to close the access opening, means defining a selectively shaped restrictive tool insert guideway extending along a path from the exterior to the interior of the housing, and control means disposed within the housing and operatively connected to the obstruction element for effecting the movement of the obstruction element out of the normally biased blocking position upon exterior insertion of a corresponding selectively shaped cooperating tool into the guideway and along such path and into coactive motion transmission contact with such control means.

9. Cabinet according to claim 8 wherein the housing is provided with an obstruction element accommodating slot in operative alignment with the obstruction element to permit projection of the obstruction element upwardly therethrough from a position remote from the predetermined path to the blocking position.

10. Cabinet according to claim 9 wherein the housing includes a plate member and a trim piece angularly extending from the plate member and having an insert aperture, the obstruction element being disposed below the plate member and the guideway extending along a path from the front toward the rear of the plate member and communicating with the insert aperture.

11. Cabinet according to claim 10 wherein the plate member is an upper plate member and the trim piece extends downwardly therefrom to a lower plate member thereby together to define a base having an enclosed space therebetween, and the obstruction element is concealed within the enclosed space and resiliently mounted at the underside of the upper plate member and normally upwardly biased to project through the accommodating slot to blocking position.

12. Cabinet according to claim 11 wherein the obstruction element includes an elongate locking rod resiliently mounted at one end thereof to the underside of the upper plate member remote from the insert aperture and having a finger segment at the other end thereof in the vicinity of the accommodating slot for projection therethrough to blocking position.

13. Cabinet according to claim 12 wherein the control means includes a cross member mounted on the elongate rod and situated crosswise of the path of the guideway for coactive motion transmission contact with the cooperating tool.

14. Cabinet according to claim 13 wherein the guideway is arranged to provide an inwardly and rearwardly directed path for the cooperating tool in operative alignment with the cross member.

15. Cabinet according to claim 8 wherein the obstruction element includes a finger segment mounted on the free end of an elongate rod with the remaining end of such rod being resiliently connected to the housing, and the control means includes a control contact portion disposed on the elongate rod intermediate the ends thereof and situated crosswise of the guideway path.

16. Cabinet according to claim 15 wherein the guideway communicates with the exterior of the housing through a restrictive slot for reception of the coperating tool.

17. Cabinet according to claim 16 wherein the sliding panel means includes a pair of opposed slightly overlapping panels and the contact surface means includes a notch in the edge of each such panel, such notches being positioned for overlapping registry in alignment with the obstruction element when the panels are moved to close the access opening.

18. Cabinet according to claim 17 wherein a corresponding selectively shaped cooperating tool is provided sized to fit such restrictive slot and to be operatively inserted into the guideway and along such path and into coactive contact with the control contact portion of the control means for effecting movement of the obstruction element out of the normally biased blocking position with respect to such notches.

19. Cabinet according to claim 18 wherein track means are provided at the access aperture for externally protectively retaining the sliding panel means in any position of movement thereof operatively along the predetermined sliding path.

20. Cabinet according to claim 19 wherein the contact surface means is disposed correspondingly adjacent to the track means for blocking contact with the obstruction element thereat.

21. Pilferage protection display cabinet arrangement which comprises a housing having an access aperture, sliding panel means movable along a predetermined sliding path for closing and opening the access aperture and having contact surface means concealed from the exterior of the housing, an obstruction element disposed within the housing and concealed from the exterior thereof, and mounted for movement into and out of blocking position and normally resiliently biased toward such blocking position for blocking contact with the contact surface means of the sliding panel means to prevent the opening thereof when such sliding panel means is moved to close the access opening, means defining a selectively shaped restrictive tool insert guideway extending along a path from the exterior to the interior of the housing, and control means disposed within the housing and hidden from the exterior thereof, and situated crosswise of the path of the guideway and operatively connected to the obstruction element for effecting the movement of the obstruction element out of the normally biased blocking position upon exterior insertion of a corresponding selectively shaped cooperating tool into the guideway and along such path and into coactive motion transmission contact with such control means.

22. Arrangement according to claim 21 wherein the sliding panel means includes a pair of opposed slightly overlapping panels, and the contact surface means includes a notch in the edge of each such panel, such notches being positioned for overlapping registry in alignment with the obstruction element when the panels are moved to close the access opening.

23. Arrangement according to claim 22 wherein the obstruction element includes a finger segment mounted on the free end of an elongate rod with the remaining end of such rod being resiliently connected to the housing, and the control means includes a control contact portion disposed on the elongate rod intermediate the ends thereof and situated crosswise of the guideway path.

24. Arrangement according to claim 23 wherein the guideway communicates with the exterior of the housing through a restrictive slot, and a corresponding selectively shaped cooperating tool is provided sized to fit such restrictive slot and to be operatively inserted into the guideway and along such path and into coactive contact with the control contact portion of the control means for effecting movement of the obstruction element out of the normally biased blocking position.

25. Arrangement according to claim 21 wherein track means are provided at the access aperture for exteriorly protectively retaining the sliding panel means in any position of movement thereof operatively along the predetermined sliding path.

26. Arrangement according to claim 25 wherein the contact surface means is disposed correspondingly adjacent the track means for blocking contact with the obstruction element, and the guideway is disposed in the vicinity of the obstruction element and communicates with the exterior of the housing through a restrictive slot for reception of the cooperating tool.

* * * * *